US010957142B2

(12) United States Patent
Villiger

(10) Patent No.: US 10,957,142 B2
(45) Date of Patent: Mar. 23, 2021

(54) SECURITY CASSETTE, COMPLETE DEVICE WITH A SECURITY CASSETTE AND METHOD FOR HANDLING VALUABLE PAPERS

(71) Applicant: Peter Villiger, Beinwil (CH)

(72) Inventor: Peter Villiger, Beinwil (CH)

(73) Assignee: Peter Villiger

( * ) Notice: Subject to any disclaimer, the term of this patent is extended or adjusted under 35 U.S.C. 154(b) by 197 days.

(21) Appl. No.: 16/154,112

(22) Filed: Oct. 8, 2018

(65) Prior Publication Data

US 2019/0108707 A1 Apr. 11, 2019

(30) Foreign Application Priority Data

Oct. 9, 2017 (EP) ..... 17195496

(51) Int. Cl.

| | |
|---|---|
| ***G07D 11/125*** | (2019.01) |
| ***E05G 1/00*** | (2006.01) |
| ***E05G 1/14*** | (2006.01) |
| ***E05G 5/00*** | (2006.01) |

(52) U.S. Cl.

CPC ..... *G07D 11/125* (2019.01); *E05G 1/005* (2013.01); *E05G 1/14* (2013.01); *E05G 5/006* (2013.01)

(58) Field of Classification Search

CPC .... G07D 11/009; G07D 11/125; G07D 11/16; G07D 11/165; E05G 1/005; E05G 1/026; E05G 1/14; E05G 5/006; G07F 19/20

USPC ..... 232/15, 16, 1 D, 43.2; 109/66; 902/9; 194/350; 235/379

See application file for complete search history.

(56) References Cited

U.S. PATENT DOCUMENTS 6,712,011 B2 * 3/2004 Fumanelli ..... E05G 1/005 109/20
9,406,208 B2 * 8/2016 Dobbins ..... E05G 1/10
9,799,179 B2 * 10/2017 Dobbins ..... E05G 1/005
(Continued)

FOREIGN PATENT DOCUMENTS

EP 1797269 B1 5/2013
EP 1891610 B1 6/2014
(Continued)

OTHER PUBLICATIONS

Search Report for Application No. EP 17195496.9, dated Apr. 25, 2018, 8 pages.

*Primary Examiner* — William L Miller
(74) *Attorney, Agent, or Firm* — McCarter & English, LLP

(57) ABSTRACT

A security cassette (100) for valuable papers (1), including a cover (101), a receiving area (102) for receiving a plurality of the valuable papers, wherein the receiving area (102) is closeable with the cover (101), a protective device (110, 112) for the valuable papers in order to enable devaluation of the valuable papers in the receiving area (102), wherein the security cassette (100) includes at least one sub-divider (120) which divides the receiving area (102) and holds valuable paper bundles (2) respectively with a plurality of bundles of valuable papers such that the valuable paper bundles (2) held by the sub-divider (120) are arranged parallel upright in the receiving area (102), and that two adjacent valuable paper bundles (2) held by the sub-divider (120) are respectively separated from one another by an intermediate space.

18 Claims, 7 Drawing Sheets

(56) References Cited

U.S. PATENT DOCUMENTS

| | | | | |
|---|---|---|---|---|
| 9,965,916 | B2 * | 5/2018 | Komatsu | G07D 11/16 |
| 10,260,273 | B2 * | 4/2019 | Yokote | G07D 11/125 |
| 10,267,081 | B2 * | 4/2019 | Yokote | G07D 11/16 |
| 10,492,584 | B2 * | 12/2019 | Yokote | B05B 1/20 |
| 2002/0026986 | A1 * | 3/2002 | Neri | B65B 7/26 156/556 |
| 2003/0122300 | A1 * | 7/2003 | Androsyuk | E05G 1/005 271/214 |
| 2004/0233618 | A1 * | 11/2004 | Ashurst | G07D 11/165 361/600 |
| 2005/0127162 | A1 * | 6/2005 | Peebles | B65H 3/08 235/379 |
| 2008/0264309 | A1 * | 10/2008 | Villiger | E05G 1/005 109/25 |
| 2011/0067463 | A1 * | 3/2011 | Copestake | G07D 11/12 70/158 |
| 2011/0155026 | A1 * | 6/2011 | Villiger | G07D 11/26 109/40 |
| 2019/0206197 | A1 * | 7/2019 | Matsuoka | G07F 19/205 |

FOREIGN PATENT DOCUMENTS

| | | | |
|---|---|---|---|
| GB | 2360327 | A | 9/2001 |
| WO | 2015189299 | A1 | 12/2015 |
| WO | 2016136029 | A1 | 9/2016 |

* cited by examiner

SECURITY CASSETTE, COMPLETE DEVICE WITH A SECURITY CASSETTE AND METHOD FOR HANDLING VALUABLE PAPERS

CROSS-REFERENCE TO RELATED APPLICATIONS

This application claims priority under 35 U.S.C. § 119(a)(d) to European patent application no. 17 195 496.9 filed Oct. 9, 2017, which is hereby expressly incorporated by reference as part of the present disclosure.

FIELD OF THE INVENTION

The present disclosure relates to a security cassette for holding bundles of valuable papers.

BACKGROUND

Security cassettes are used to hold valuable papers, especially paper money, during storage on the one hand, for example after filling in cash centers and during transport. The safety cassettes usually have a trough-like container (referred to here as the lower part) with an access opening that can be closed by a cover element or a flap. Special tools and/or measures must be used to close and, in particular, open the access opening.

In addition, the security cassettes have a protective device. The protective device is used to make the theft of the security cassettes and the valuable papers located therein unattractive to a potential thief. This is done by devaluing the valuable papers as soon as there is deviation from the intended situation of the security cassette. The protective device can also be configured to emit alarm signals.

The terms "situation" and "deviation from the intended situation" or like terminology are to be understood in a broad sense. For example, "situation" may refer not only to the local situation, but also to the respective time and the respective threat situation. A "deviation" may mean that the location, time and threat situation are different than intended. A "deviation" may be caused, for example, by an attempt by unauthorized persons to open a security cassette, in particular in an improper manner, or to remove it from a receptacle, or to expose it to certain mechanical loads, or to transport it over a greater distance or for a longer period than intended.

Prior to the present invention, devaluating usually took place by the protective device applying a suitable liquid, e.g., ink, to the valuable papers, by which the valuable papers are colored or stained. However, there existed other means of devaluation, such as foam that expands and hardens.

The protective device of the security cassette can typically be brought from an idle state to an armed state. The protective device cannot be tripped in the idle mode. In the armed state, automatic tripping always occurs when the current situation of the security cassette, which may also be regarded as the actual current situation, deviates from the intended situation or target situation. In order to avoid undesirable devaluation of the valuable papers, an armed protective device must be put back to idle state if, for example, the security cassette is to be opened by authorized personnel.

The protective device is armed in accordance with a respective intended situation of the security cassette. In other words, the protective device of the security cassette can, depending on the type of the current or planned situation of the security cassette, be brought into different arming modes. In this case, the aim is to prevent unnecessary tripping of the protective device and at the same time not to block any necessary tripping of the protective device. For example, the protective device of a security cassette must be was more sensitive to mechanical influences such as knocks or movements when the security cassette is stationary in one place than when the security cassette is in transit. The intended situation or target situation or parameters which determine the corresponding arming mode of the protective device of the security cassette are programmed into the protective device or are fixed.

Prior to the present invention, security containers have been used to transport security cassettes. These security containers can also be used to hold the security cassettes during their storage, filling and transport. The security containers generally have several receptacles of the same or different design, each of which can hold a security cassette. The receptacles on the one hand and the security cassettes on the other have interacting locking means or closure means with which the security cassettes can be locked, locked away or sealed in the receptacles. The security cassettes are not necessarily completely surrounded by the receptacles or security containers, but can only be docked there, so that they can be at least partially visible or directly accessible from outside the security containers, for example, to remove them from the receptacles.

It has been recognized that the effort and the associated costs for the logistics of security cassettes can sometimes be very high. In addition, people are still a factor that must be taken into account in the overall security concept of such a logistics chain. However, not only people can prove to be a weak point in the security concept under certain circumstances. This also entails training, further education, and personnel costs, which contribute to a further increase in the cost of the logistics chain.

A typical or exemplary procedure for using the security cassettes follows: The security cassettes are filled manually in a cash center. They are then picked up by a driver and transported by a transport vehicle to their place of use, for example a bank or ATM station. Before and after transport in the transport vehicle, short, locally restricted transports can be carried out using a trolley. In the cash center, in the transport trolley, in the transport vehicles and in the ATM station, the security cassettes are located in the security containers therein. The security containers of the different locations can be different, but were designed in such a way that different receptacles are present in order to be able to receive and lock different types of security cassettes. The security containers or receptacles may have monitoring devices that react to unforeseen situations.

An overall system included, for example, several security cassettes, several stationary and mobile security containers (e.g. transport trolleys) as well as a monitoring system to monitor the security cassettes as permanently as possible.

Until today, the monitoring of security cassettes is similar to the monitoring of shipments transported by courier companies, namely with the help of manually operated PDA devices which are designed to read the identifiers of the individual security cassettes and to link them with associated information such as time and/or location. The selection or programming of the desired arming mode for the protection systems of the security cassettes is also carried out with the help of such PDA devices.

It is obvious that this conventional method of monitoring and arming or programming the security cassettes is demanding, time-consuming, prone to failure, and can be manipulated.

SUMMARY OF THE INVENTION

It is therefore an object to develop a new security concept which on the one hand ensures improved security for the valuable papers and the staff, but on the other hand also contributes to keeping costs within reasonable limits.

For example, it is an object to create

- a new security cassette,
- a new overall device, and
- a new method with which the disadvantages of the prior art can be avoided.

In principle, prior security cassettes (also called cash cassettes) are known, for example from patent specifications EP1797269 B1 and EP1891610 B1.

The new security cassette(s) differs in at least some embodiments from prior security cassettes in that it is specially configured for partially or fully automated handling. This means that the security cassette is configured so that it only has to be filled and/or emptied partly or not at all by hand.

However, this requires a new concept, as the previously known security cases and security cassettes are not suitable to achieve this functionality.

According to an embodiment, a security cassette for securities is provided, comprising

- a cover which may be completely removable,
- a receiving area for receiving a plurality of the valuable papers, wherein the receiving area is closable with the cover,
- a protective device for the valuable papers, which can be triggered automatically in order to devalue the valuable papers in the receiving area.

In one aspect, a security cassette includes a receiving area for receiving valuable papers, a cover for closing the receiving area, and a protective device for devaluing the papers. At least one sub-divider is mountable in the receiving area for dividing it and holding the papers upright and parallel in the receiving area.

In another aspect, a system includes the security cassette and an automatically operating handling device. The automatically operated handling device includes a gripper for removing valuable paper bundles from the receiving area and supplying them for processing.

Another aspect includes processing a security cassette closed by a cover and having valuable paper(s) within. An exemplary method may include opening or removing the security cassette's cover, inserting a gripper of an automatically operating handling device into the security cassette, gripping valuable paper(s), removing such from the security cassette and delivering same to a location outside of the security cassette, and processing the delivered valuable paper(s).

An embodiment of the security cassette comprises at least one sub-divider which is configured to be mounted in the receiving area in such a way that it divides the receiving area. Furthermore, the sub-divider has a kind of rib structure in order to be able to hold valuable paper bundles respectively with a plurality of valuable papers in bundles in such a way that valuable paper bundles held by the sub-divider are arranged parallel upright in the receiving area, and that two adjacent valuable paper bundles held by the sub-divider are each separated from one another, either by an intermediate space, or that a sub-divider is arranged between each two adjacent bundles of valuable papers.

According to one embodiment, one sub-divider each is arranged between two adjacent valuable paper bundles. In this embodiment, the sub-divider has a ribbed structure on both sides in order to define intermediate spaces for gripper elements on the valuable paper bundles.

In other words, no more outer packaging, such as moneybags, is used; instead, the valuable papers are transported open in bundles in the security cassette.

This measure makes partial or even full automation possible, since a gripper, which is part of an automatically operating device, e.g., a robot, for example, can easily insert the valuable paper bundles into the security cassette and/or remove them from the security cassette.

If self-propelled robot vehicles, such as driverless vehicles, are used in the cash center, conveyor belts that were previously used may be omitted. This has the advantage that more space is available.

If the cash center is partially or fully automated, some or all of the human-machine interactions may be eliminated. It is precisely these interactions that make such systems expensive and also susceptible to faults.

In one embodiment, the security cassette is equipped with communication technology so that it can be opened via infrared communication, for example, via a PDA or smartphone. Infrared communication according to the IRDA standard is suitable. It should be understand that the term "PDA" herein refers not only to a Personal Digital Assistance, but any suitable electronic or computerized device configured to carry out the described function(s) of the PDA.

In some embodiments, the security cassette is equipped in such a way that the security cassette supplies not only the valuable papers but also information from a location A (e.g., from the customer) to a location B (e.g., a cash center or another location). This means that, in these embodiments, the security cassette is also an information carrier and means of communication, since with the security cassette the contained information reaches a location B from a location A.

The security cassette is equipped in some embodiments in such a way that it is loaded at location A with valuable papers and information. In addition, at least one sub-divider may be inserted into the security cassette before the valuable papers are inserted. Information can be loaded using software and a communication interface that is available (installed) at location A. Information can also be loaded using software and a communication interface that a money courier brings to location A. This software can be installed, for example, in a PDA or smartphone. The corresponding communication interface then establishes a communication connection between the PDA or smartphone and the security cassette if required.

The same information stored in the security cassette may also be transmitted in some embodiments to a computer (e.g. at location B) via another communication connection. This approach results in redundancy of information. This redundancy is advantageously used in these embodiments at location B to compare the information in the security cassette with the information transmitted via the other communication connection. This significantly increases security and reduces the risk of manipulation.

At least some embodiments enable a transition from purely manual handling to semi-automated and ultimately also fully automated handling. This makes all cash-in-transit processes simpler, cheaper, and at the same time more secure.

This summary is not exhaustive of the scope of the present aspects and embodiments. Thus, while certain aspects and embodiments have been presented and/or outlined in this summary, it should be understood that the present aspects and embodiments are not limited to the aspects and embodiments in this summary. Indeed, other aspects and embodiments, which may be similar to and/or different from, the aspects and embodiments presented in this summary, will be apparent from the description, illustrations and/or claims, which follow.

It should also be understood that any aspects and embodiments that are described in this summary and do not appear in the claims that follow are preserved for later presentation in this application or in one or more continuation patent applications.

BRIEF DESCRIPTION OF THE DRAWINGS

Further details and advantages will become apparent from the following description of exemplary embodiments, which are to be understood not to be limiting, and with reference to the drawings.

DETAILED DESCRIPTION

Referring to the figures, constructive elements are represented in solid lines, signals or signal lines (called communication connection here) are symbolized by dashed arrows.

Figure 2:
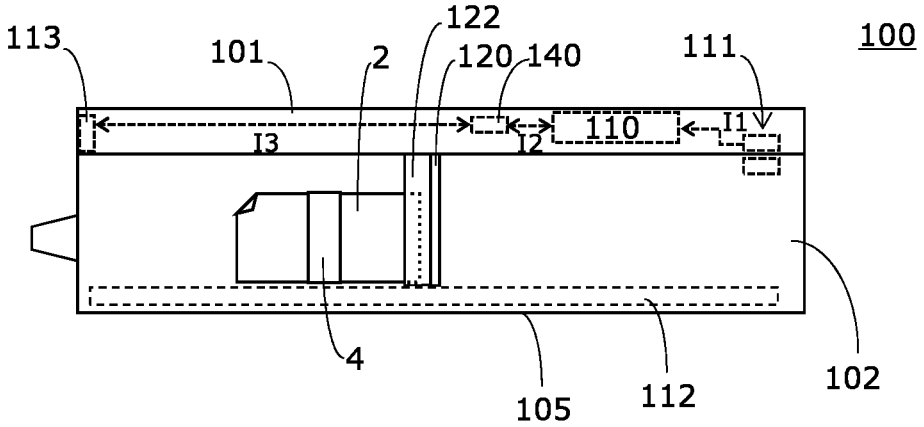
FIG. 2 schematically shows a security cassette.

FIG. 2 shows a first security cassette 100. Details are shown here with schematic elements, which are also used for other embodiments shown in the figures.

The security cassette 100 has a kind of trough part (called receiving area 102) for receiving valuable paper bundles 2 (here, for example, surrounded by a sleeve 4) and a cover 101 for closing an access or filling opening of the receiving area 102. The cover 101 is detachably arranged on the receiving area 102 (e.g., locked or otherwise secured). Instead of a cover 101, a flap, a slide, a door, or other means can also be used for any embodiment. The term "cover" shall include these variants. The cover 101 can be completely removed so that an external gripper 130 (see, e.g., FIG. 6D or FIG. 7) has access to the valuable paper bundles 2, or it may alternatively be possible to remove the cover 101 to an extent that access is possible using an external gripper 130 (see, e.g., FIG. 6D or FIG. 7).

Exemplary details of a suitable security concept and a possible embodiment of the protective device 110 are described below.

Figure 1:
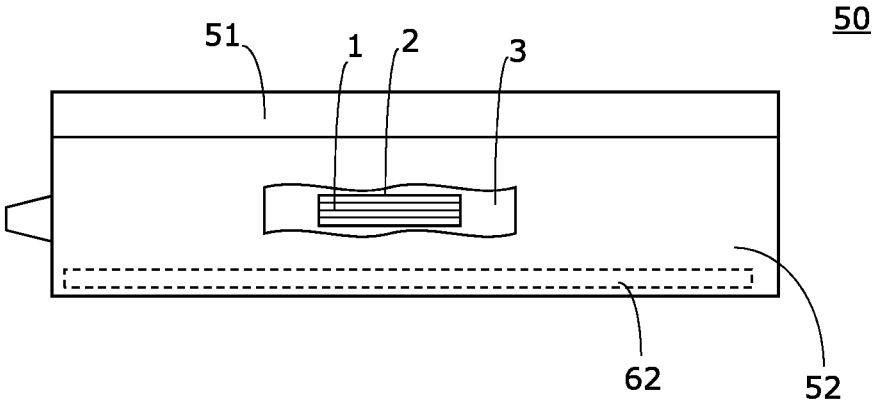
Fig. 1 PRIOR ART
FIG. 1 schematically shows a prior art security cassette.

The security cassette 100 includes a protective device 110 for the valuable papers 1. This protective device 110 is configured to automatically trigger in order to devalue the valuable papers 1 in the receiving area 102 in the event of such triggering. Since the valuable papers 1 are transported in an open condition, i.e., without outer packaging 3, the devaluation process is significantly faster and more reliable than previously. In previous systems, for example, an outer packaging 3 (see FIG. 1) had to be melted inside the security cassette 50 (which includes a cover 51, receiving area 52, and ink module 62) before, for example, ink could penetrate the valuable papers 1.

The security cassette 100 comprises at least one sub-divider 120 (shown in FIG. 2 from the side) which is configured to be mounted in the receiving area 102 in such a way that it divides the receiving area 102. The sub-divider 120 comprises a kind of ribbed structure 122 in order to be able to hold the valuable paper bundles 2 respectively with a plurality of valuable papers 1 in bundles in such a way that valuable paper bundles 2 held by sub-divider 120 are arranged parallel upright in the receiving area 102. These locations and directions refer to a security cassette 100 in its normal position (as shown in the figures).

The valuable paper bundles 2 may be arranged vertically to a sub-divider 120, or the valuable paper bundles 2 are arranged parallel to the sub-divider 120.

Figure 5A:
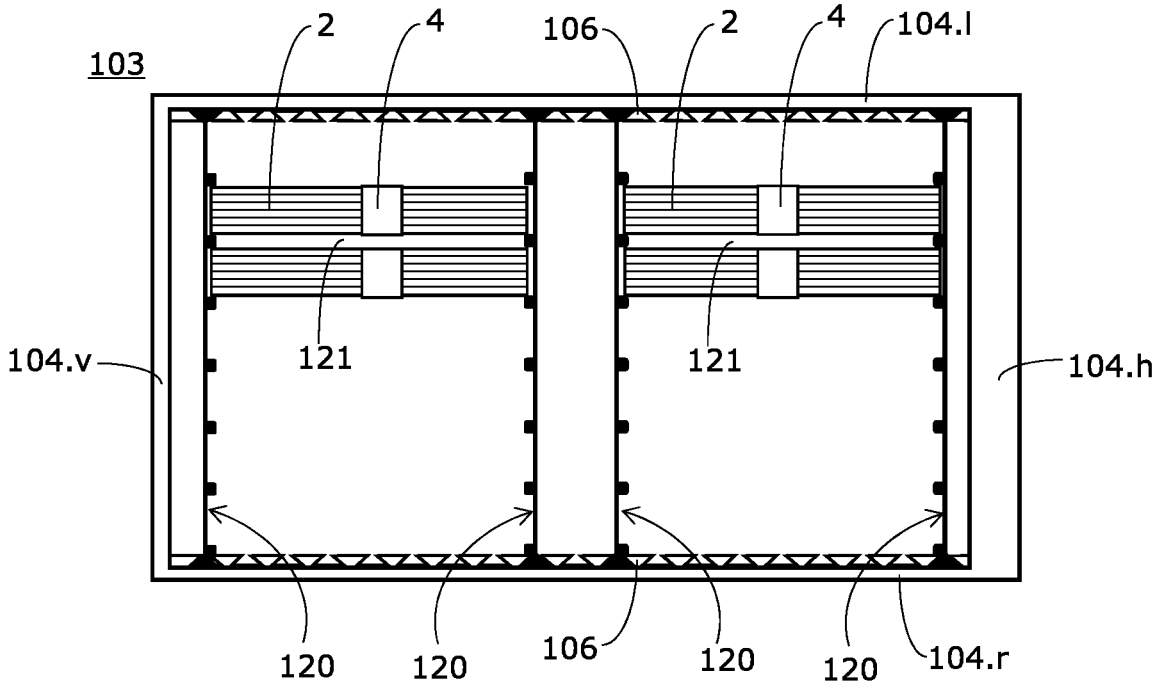
FIG. 5A schematically shows another security cassette in a top view, with its cover removed and the security cassette equipped with four sub-dividers in order to be able to arrange valuable paper bundles in longitudinal direction of the security cassette.

The sub-divider(s) 120 can be configured in such a way that two adjacent valuable paper bundles 2 held by the sub-divider 120 are respectively separated from each other by an intermediate space 121 (see, e.g., FIG. 5A). The valuable paper bundles 2 in FIG. 5A are arranged here perpendicularly to the sub-divider 120.

Figure 5B:
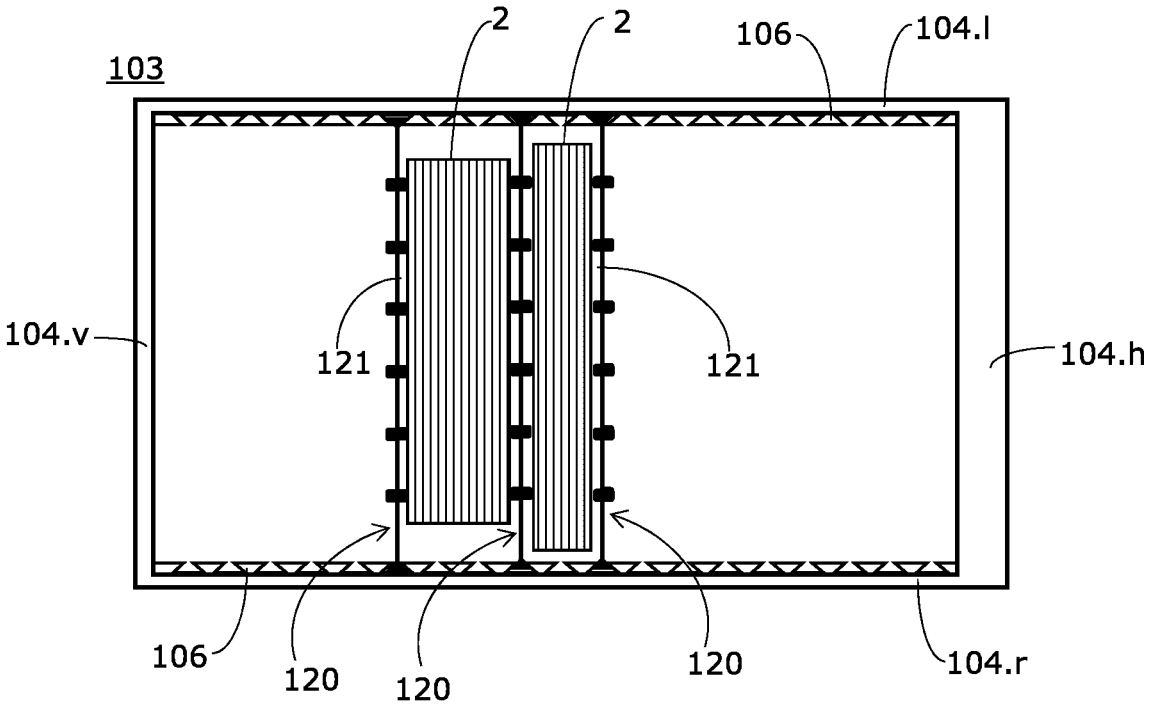
FIG. 5B schematically shows another security cassette in a top view, with its cover removed and the security cassette equipped with three sub-dividers in order to be able to arrange valuable paper bundles in the transverse direction of the security cassette.

The sub-divider(s) 120 may be configured so that there are several intermediate spaces 121 in the area between a sub-divider 120 and the valuable paper bundle 2 adjacent to it (see, e.g., FIG. 5B). Valuable paper bundles 2 are in FIG. 5B arranged generally parallel to the sub-divider 120.

The sub-divider 120 may include a unique identifier (here called Unique Identifier or UID). UIDs include, for example, barcode labels or similar labels which are machine-readable. Machine readable in this case is a label that can be read and recognized by a reader (which can be part of a PDA 150 or smartphone, for example).

However, a human-readable label can also be used. This label may be scanned with a reader, for example, and converted into machine-readable information using character recognition (e.g., OCR). However, the information read by humans can also be entered manually using a keyboard (e.g., the PDA 150).

Such a UID can be used to give the security cassette 100 information about the current configuration. This means that the security cassette 100 "knows" with which and with how many sub-dividers 120 it is currently equipped.

The sub-divider 120 can be made of metal (e.g., aluminum sheet) or plastic, or any other suitable material, as would be understood by one of ordinary skill in the art.

The sub-divider 120 may have the above-mentioned ribbed structure 122 and borders or edges which are configured for plugging in, pushing in, or insertion into laterally arranged receiving structures 106.

Figure 4:
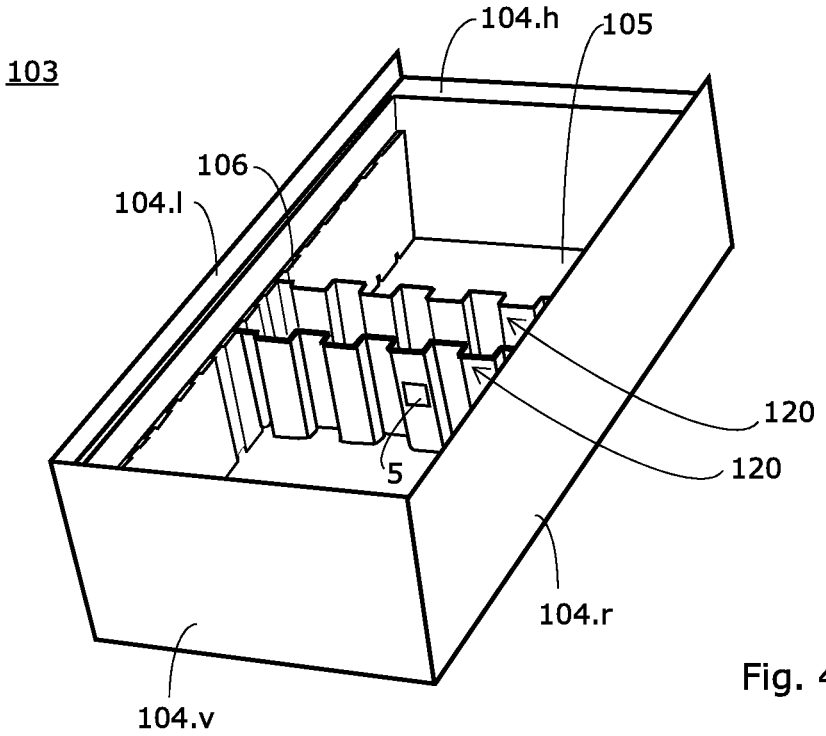
FIG. 4 schematically shows another security cassette in a perspective view, with its cover removed and the security cassette equipped with two sub-dividers.

The sub-divider 120 can include a chip 5 (e.g., an RFID chip), which can be read out in a contactless manner. In FIGS. 4 and 6C, such a chip 5 is shown as an example on one of the sub-dividers 120. In this chip 5, the UID, for example, can be stored. In this chip 5, for example, the name or an identification of the person who has loaded the security cassette 100 with the sub-divider 120 can be stored.

A security cassette 100 can, for example, also be filled by several persons with valuable paper bundles 2. In this case, each of these persons may use a particular sub-divider 120 or sub-dividers (that is, one or more sub-dividers that are assigned to this person). In this case, the chip 5 of the sub-divider 120 stores the name or an identification of the person and information on the amount of money with respect to that sub-divider.

Alternatively or additionally, the information about the current configuration can be transmitted to a computer (e.g., in the cash center) via a communication connection. This can be done, for example, via a communication connection I5 from a PDA 150 to a computer 165, as shown schematically in FIG. 7. In this case, the PDA 150 has previously read the current configuration of the security cassette 100 in order to then send it to the computer 165.

In this case, the cash center CC is a contact point to handle valuable papers 1. It may be, but does not have to be, a fully equipped cash center CC in the conventional sense.

Figure 7:
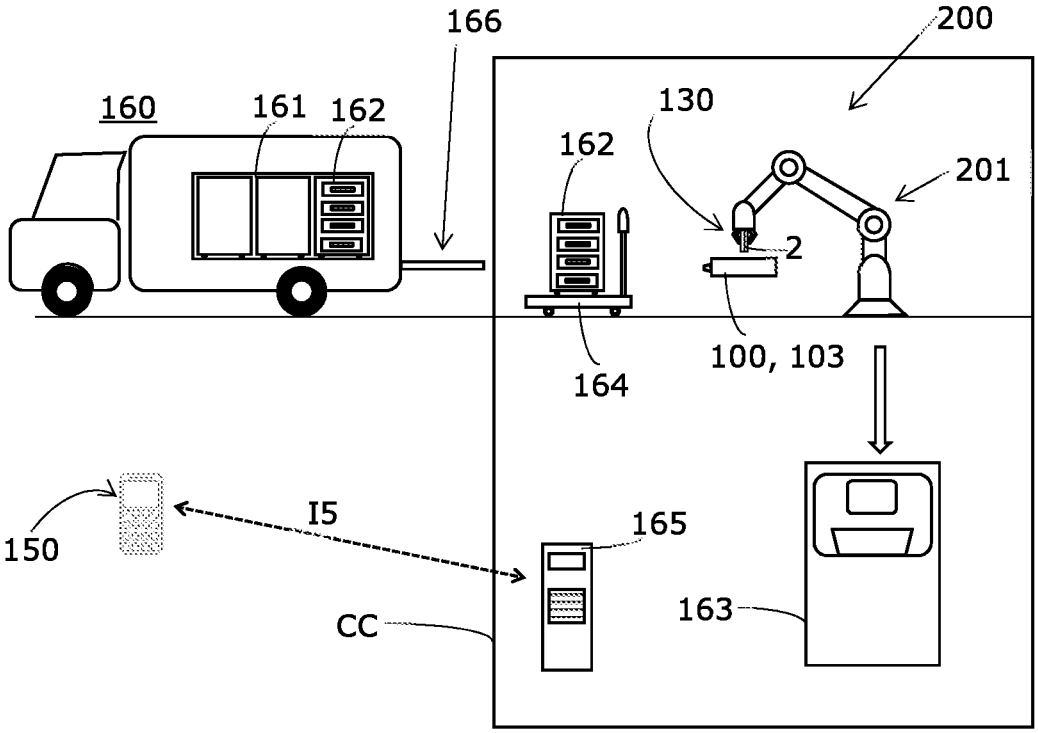
FIG. 7 shows a system for automated handling of security cassettes.

The computer 165 associated with the cash center CC, does not necessarily have to be located in the cash center CC, as shown schematically in FIG. 7. It can also be a computer 165 in a data center or at another location.

This way, when opening the security cassette 100, it is possible to check whether the original configuration has been changed. This measure can also help to detect manipulations.

In at least some embodiments, the security cassette 100 can be freely or variably configurable. This means that the sub-divider(s) 120 can be arranged and fastened in different positions in the interior of the lower part 103 (also called receiving area 102).

The receiving area 102 can in some embodiments be limited by four side walls 104.*l*, 104.*r*, 104.*v*, 104.*h*, and by a floor 105. In FIG. 4, the four side walls 104.*l*, 104.*r*, 104.*v*, 104.*h*, and the floor 105 are clearly visible.

The receiving area 102 may comprise at least two opposite side walls 104.*l*, 104.*r*, each of which is equipped with at least one receiving structure 106 for holding the at least one sub-divider 120.

Figure 3:
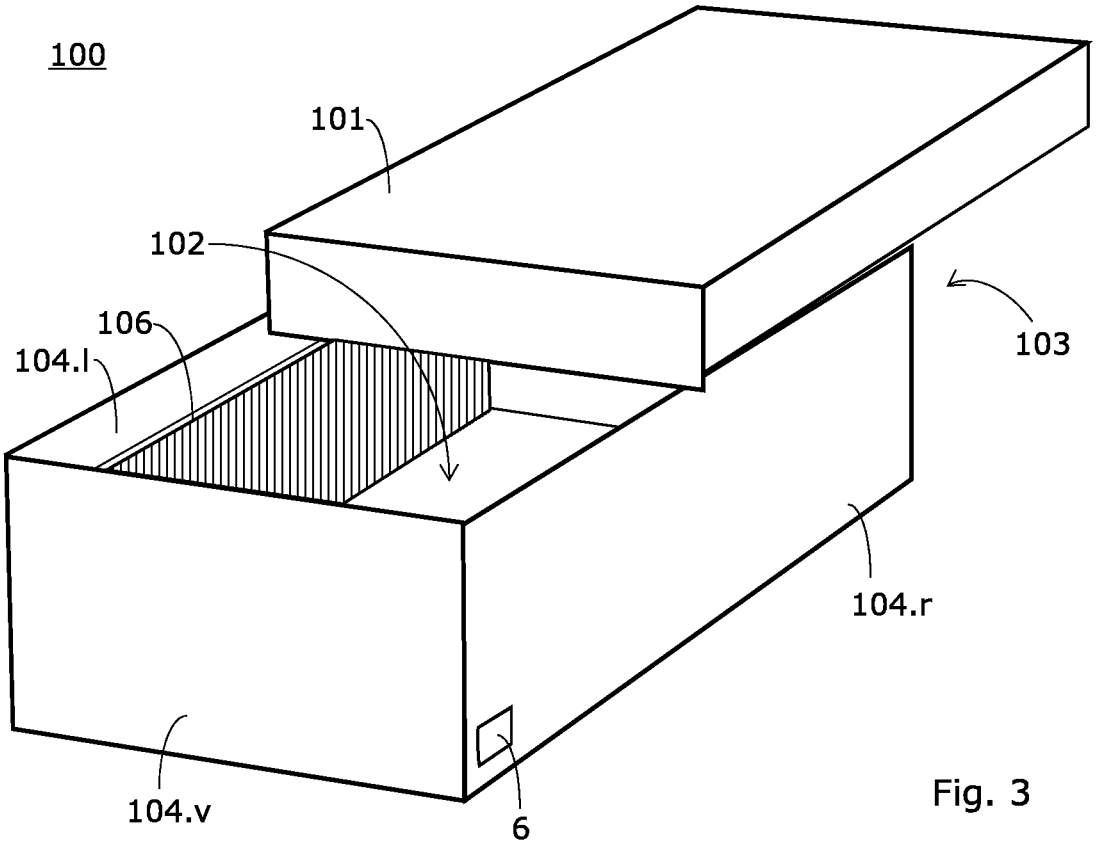
FIG. 3 schematically shows another security cassette in a perspective view, with its cover removed.

FIG. 3 shows an exemplary receiving structure 106 of the side wall 104.*l*. This receiving structure 106, for example, comprises a large number of vertical slots that are configured for inserting a sub-divider 120.

In FIG. 4, another exemplary receiving structure 106 can be seen on the side wall 104.*l*. This receiving structure 106 comprises a periodic arrangement of slots and webs. The slots and webs are shown more precisely in the area of the two sub-dividers 120.

FIGS. 5A and 5B show further exemplary receiving structures 106 on the side walls 104.*l* and 104.*r*. These receiving structures 106 comprise a periodic arrangement of trapezoidal slots and trapezoidal webs. The slots (shown in white) and webs (shown in black) allow the insertion from above of sub-dividers 120, which have complementary means at the vertical edges. In this embodiment, a kind of tongue-groove connection thus results.

The sub-dividers 120 and/or the receiving structures 106 can be configured to plug or insert the sub-divider 120 into the receiving structures 106 from one cover side, wherein the sub-divider 120 in the plugged-in or inserted state is then perpendicular to the two opposite side walls 104.*l*, 104.*r* (see also FIGS. 5A and 5B).

The sub-divider(s) 120 may include a corrugation device and/or a vertical slit and/or a succession of ribs and grooves as rib structure 122. FIG. 4 shows two sub-dividers 120 with a corrugation device.

In FIG. 5A, on the other hand, four sub-dividers 120 with slender ribs and wide grooves are shown. The slender ribs, which can be seen here in plan view as small black rectangles, sit only on one side of the sub-dividers 120.

In FIG. 5B, on the other hand, three sub-dividers 120 with slender ribs and wide grooves are shown. The slender ribs, which can be seen here in plan view as small black rectangles, are located on both sides of the sub-dividers 120.

The sub-divider(s) 120 may be configured such that either two adjacent valuable paper bundles 2 held by the sub-divider 120 are separated from one another by an intermediate space 121, as can be seen, for example, in FIG. 5A, or that one valuable paper bundle 2 is respectively held between two sub-dividers 120 in such a way that several intermediate spaces 121 result between the sub-dividers 120 and the valuable paper bundle 2, as can be seen, for example, in FIG. 5B.

In the following, exemplary details of a security concept and a possible embodiment of the protective device 110 are discussed.

At least one (cover) sensor 111 may be present in some embodiments to detect the closing and/or locking of the cover 101. Such a (cover) sensor 111 is shown in FIG. 2 as an example.

In FIG. 2 it is also shown schematically that an element of the protective device 110 can also be accommodated in the cover 101. It can be an electronic circuit, for example, which is in communication connection with various sensors (e.g., with the (cover) sensor 111). The communication connection between the (cover) sensor 111 and the protective device 110 is symbolized by a dotted arrow I1.

Figure 8:
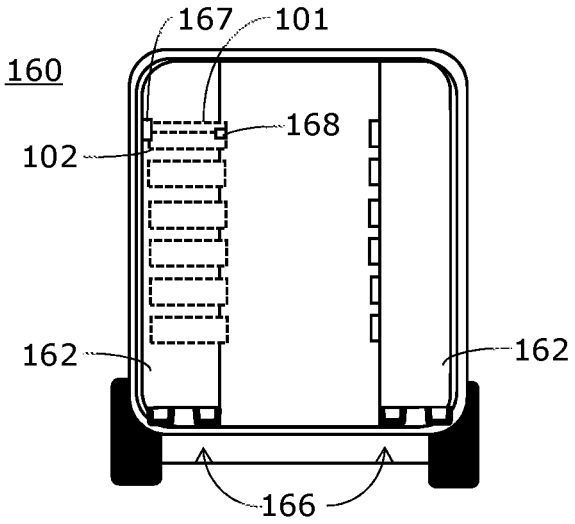
FIG. 8 shows a vehicle in a rear view, which may be used with embodiments disclosed herein.

The cover 101 can be unlocked or opened, for example, with a specific tool (e.g., a PDA 150 or a token) and/or a specific code to be entered. A respective lock 168 is shown in FIG. 8.

In addition, the security cassette 100 has a protective device 110, which has means for protecting the valuable papers 1.

The protective device 110 may include a device for the devaluation of valuable papers 1. The protective device 110 includes, for example, an ink or foam module 112 whose design and mode of operation is known in the art. The ink or foam module 112 of the protective device 110 may, for example, be mounted on opposite surfaces of the security cassette 100. FIG. 2 shows an embodiment which comprises an ink or foam module 112 on the base 105.

The protective device 110 may include ink or foam modules 112 in several places or in several areas of the security cassette 100.

The ink or foam module 112 can be triggered directly or indirectly by the electronic circuit of the protective device 110.

The protective device 110 may be configured such that it is in an idle state in which it is not armed and in which it thus cannot be triggered automatically. The valuable papers 1 in the security cassette 100 are then only protected insofar as the cover 101 of the security cassette 100 cannot be opened without the code and/or the corresponding instrument. In the idle state, therefore, no automatic devaluation of valuable papers 1 takes place.

The protective device 110 can be configured such that it can be armed. If it is in this armed state, it is, in at least some embodiments, automatically triggered as soon as the situation of the security cassette 100 deviates from its intended or predetermined situation. For example, when arming protective device 110, the security cassette 100 can be placed in different or differently sensitive arming modes, depending on the intended or expected threat condition(s), by setting certain parameters defining these arming modes accordingly. The change from one arming mode to another arming mode can be pre-programmed in some embodiments, for example, and can be carried out according to rules. The change from one arming mode to another arming mode can, however, also or alternatively be made from the outside (e.g., by a PDA 150 or by a transmitter of a transport trolley).

Figure 6A:
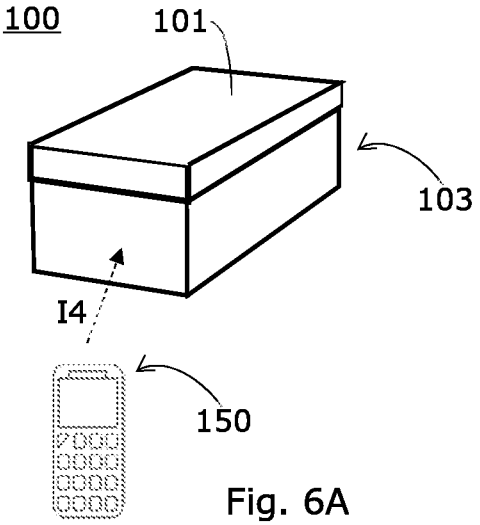
FIG. 6A shows another security cassette in a closed, armed state, in which a PDA can be used to open the cover.

Instead of a PDA 150, as shown schematically in FIG. 6A, a computer device 150 can also be used, which is designed to communicate with the security cassette 100. This communication is indicated in FIG. 6A by a dotted arrow 14.

The communication between the computer device 150 and the security cassette 100 can be unidirectional or bidirectional (depending on requirements and security concept).

Triggering the protective device 110 will result in the valuable papers 1 being devalued by the ink and/or the foam of the ink or foam module 112.

The security cassette 100 can be configured so that it has a receiver device 113. In FIG. 2, such a receiver device 113 is shown in the cover 101 as an example.

Depending on requirements, receiver device 113 can be designed for optical communication, for communication via radio frequency (RF), or for communication via sound waves (e.g., in the ultrasonic range). The receiver device 113 may also include any suitable communication method, mechanism or means as should be understood by one of ordinary skill it the art, or a combination of more than one of the aforementioned communication channels or means for all types.

Signals received via one of the communication paths or means may, for example, cause the protective device 110 to switch to a respectively required arming mode. For example, if a cash center CC transmits a corresponding signal to the security cassette 100 after the security cassette 100 has been placed inside the cash center CC, the protective device 110 can switch to a lower-level arming mode because the cash center CC is a (relatively) secure environment.

Furthermore, the security cassette 100 can include a transmitter device, e.g., to be able to transmit signals. A transmitter device is not shown in the figures, but can sit next to or be combined with the receiver device 113, for example.

In addition, the security cassette 100 can be equipped with a variety of sensors in order to be able to detect unwanted effects or unforeseen changes in the (ambient) situation independently at any time and to arm the protective device 110 accordingly and/or to trigger the protective device 110.

Certain embodiments may have one or more of the following sensors in or on the security cassette 100:

the aforementioned (cover) sensor 111 configured to determine whether the cover 101 closes the access opening, an impact sensor, a position sensor, a timer to set a maximum transport time, a temperature sensor operating absolutely or relatively, a pressure sensor operating absolutely or relatively, a brightness sensor, an acoustic sensor, a sensor for chemical substances (e.g., designed as a gas or acid sensor).

In addition, the protective device 110 can optionally be configured to take tolerances into account, for example, in the event of time delays, pressure changes, and the like.

These sensors and their use should be understood by persons skilled in the art.

The individual sensors can optionally be configured to be activated or deactivated, depending on the selected arming mode.

The following list contains examples of two arming modes, for example, for a less sensitive cash center arming mode and for a transport mode. The sensitivity here refers, for example, to movements and impacts.

| | Arming mode "Cash Center" | Arming mode "Transport" |
|---|---|---|
| Impact sensor | Deactivated | Maximum of two impacts are tolerated |
| Triggering after (ms) | 0 | After two impacts in 10 s |
| Position sensor | Activated | Deactivated |
| Timer | Activated | Deactivated or time on sidewalk predetermined |
| Cover sensor 111 | Activated | Activated |
| Temperature sensor (ΔT/Time) | Activated | Deactivated |

In addition, a service mode can also be provided, for example, for opening the security cassettes 100, which allows opening by an authorized person or by an automatically operating device (e.g., the robot 201) without activating the protective device 110.

Not all sensors mentioned above, or even none, are necessarily present in some embodiments, but optionally other sensors may also be available, as should be understood by one of ordinary skill in the art. The individual parameters can be selected or set differently than indicated above in a manner that one of ordinary skill in the art would appreciate. Variable parameters can also be specified.

In addition, the protective device 110 can optionally include a surface protection, which is designed to physically prevent penetration into the security cassette 100 and/or to detect drilling, opening by prying, blasting, and the like, and to report it to the protective device 110.

Status information may be stored in the security cassette 100 before, during, or after filling the security cassette 100. For this purpose, the shown security cassette 100 includes a memory 140. This memory 140 can be located in the cover 101, in or on the receiving area 102, or in the cover 101 and in the receiving area 102, or any other appropriate location.

The memory 140 may be configured to store security-relevant and/or transport-relevant data. For the sake of simplicity, these data are here referred to as status information.

The memory 140 may be designed configured to store the status information in non-erasable form in order to prevent misuse. For this purpose, a non-changeable or non-erasable memory 140, as generally known, may be used.

In FIG. 2, a memory 140 is shown schematically, which is connected to the protective device 110 via a bidirectional communication connection I2. The status information can be written into memory 140, for example, via a receiver device 113 and a communication connection I3, in which case an interface (not shown) between the receiver device 113 and the memory 140 may be used to control and regulate access to the memory 140.

The security cassette 100 can include a chip 6 (e.g., an RFID chip), which can be read out in a contactless manner (such a chip 6 is shown as an example in FIG. 3). In this chip 6, for example, the status information (as a whole or in part) can be stored. In this chip 6, for example, the name or an identification of the person who has equipped the security cassette 100 with the sub-divider(s) 120 can be stored.

In the following, various exemplary, non-limiting methods are described in which at least one security cassette 100 is used.

Collection of Valuable Papers from the Customer (Method A):

A money courier comes to the customer with a security cassette 100 (e.g., on order). The security cassette 100 is opened e.g., by means of a PDA 150 (or generally with a portable computer device 150), which the money courier brings along. On the PDA 150, for example, an application can be installed that allows the money courier opening. The security cassette 100 can, for example, also be opened using a special instrument (e.g., a key token.

Before opening, the security cassette 100 is disarmed, i.e., the protective device 110 allows opening without triggering.

Now money (in the form of valuable papers 1) is put into the security cassette 100, wherein the valuable papers 1 are placed in bundles between the sub-divider 120.

In addition, status data is recorded (e.g., using the PDA 150) and the status data is written to the memory 140 of the security cassette 100. Alternatively or additionally, the status data can also be transmitted to a computer 165 (e.g., in a cash center CC) via a communication connection I5.

The status data may include at least one piece of information on the amount of the money, which was packed into the security cassette 100 at the customer's premises.

Now the security cassette 100 is closed and armed. Arming can be done automatically, or arming can be done by the money courier (e.g., using the PDA 150).

Now the money courier is provided with a time window to bring the security cassette 100 into a transport vehicle 160 (e.g., a cash transporter) and put or push it into a shelf 161.

Collection of Valuable Papers from the Customer (Method B):

If the customer already has a security cassette 100, the customer may use computer-based software to enter all status data and, for example, transfer it to a computer 165 (e.g., in a cash center CC).

The status data can also be stored in the memory 140 of the security cassette 100.

The status data can include at least one indication of the amount of money that the customer has packed or will pack in the security cassette 100.

Then the customer enters whether and when he/she wishes the security cassette 100 to be collected.

A money courier comes to the customer (e.g., at the time ordered) and takes over the security cassette 100 in the condition already closed by the customer. If desired, he/she can hand over another security cassette 100 (which can be empty or filled with money) to the customer.

Now the money courier has a time window to bring the security cassette 100 into a transport vehicle 160 (e.g., a cash transporter) and put or push it into a shelf 161.

Unloading the Transport Vehicle:

In order to be faster and more efficient than current methods, the transport vehicle 160 can be equipped with a shelf 161, which can be removed completely or partially from the vehicle 160.

The transport vehicle 160 may include a shelf 161 with an internal rack 162. This internal rack 162 holds several of the security cassettes 100 and it can be removed as a whole from shelf 161, as indicated in FIG. 7.

The removal of the shelf 161 from the vehicle 160 can be carried out automatically in some embodiments. For this purpose, the vehicle 160 can be parked at a loading ramp, in a lock or in a security area before a device 200 automatically removes the shelf together with the security cassettes 100.

At this moment, shelf 161 can be placed in the cash center CC, or it is placed on a robot vehicle 164 to be automatically moved to the unloading location.

One advantage of this automated approach is that not every security cassette 100 has to be removed individually. Previously, loading and unloading a vehicle takes 15 to 20 minutes. The automation described here can reduce this time to a few minutes.

In some embodiments, the shelf 161 is equipped with at least one internal rack 162 so that all or part of it can be removed from the vehicle. For this purpose, the internal rack 162 can be equipped with castors to make it easier to move it manually or automatically.

Unloading the Security Cassette:

After the security cassette 100 has arrived at the cash center CC, it can be emptied manually in the conventional way or by partially or fully automated emptying of the security cassette 100.

This principle is described below with reference to FIGS. 6A to 6F. It should be noted that FIGS. 6C and 6D show a first possible use of the security cassette 100. FIGS. 6E and 6F, on the other hand, show a second possible use of the security cassette 100. Further exemplary details are shown in FIG. 7.

FIG. 6A shows the security cassette 100 in a cash center CC. The cover 101 is still on the lower part 103 and the protective device 110 is in armed condition.

Now, for example, the content of the memory 140 is read, which can be done with a PDA 150 or another suitable device. In a first step, the data can be briefly checked by comparing the status data from the memory 140 of the security cassette 100 with the status data that has otherwise been sent from the customer to the cash center CC (e.g., via the computer 165 of the cash center CC).

If deviations are detected here, manipulation can be assumed and the security cassette 100 is subjected to a special handling routine.

By reading out the memory 140 and/or as a result of the status data transmitted by other means (e.g., via communication connection I5), the current configuration of the security cassette 100 and the amount of money contained in it are known.

This information now enables partially or fully automated emptying of the security cassette 100.

Figure 6B:
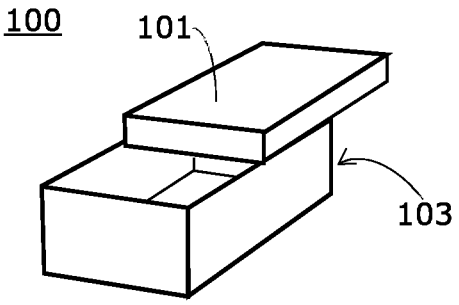
FIG. 6B shows the security cassette of FIG. 6A with the cover partially opened.
Figure 6C:
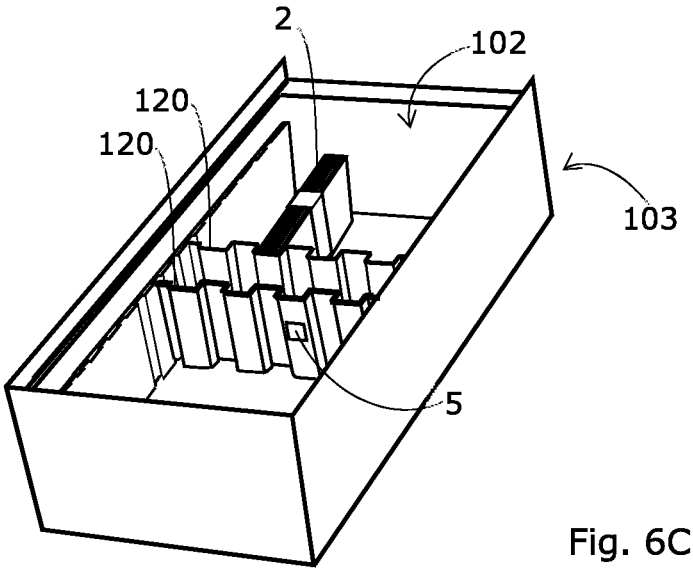
FIG. 6C shows the security cassette of FIG. 6A with the cover removed, wherein the security cassette is equipped with two sub-dividers and contains a valuable paper bundle which is arranged in the longitudinal direction of the cassette.
Figure 6D:
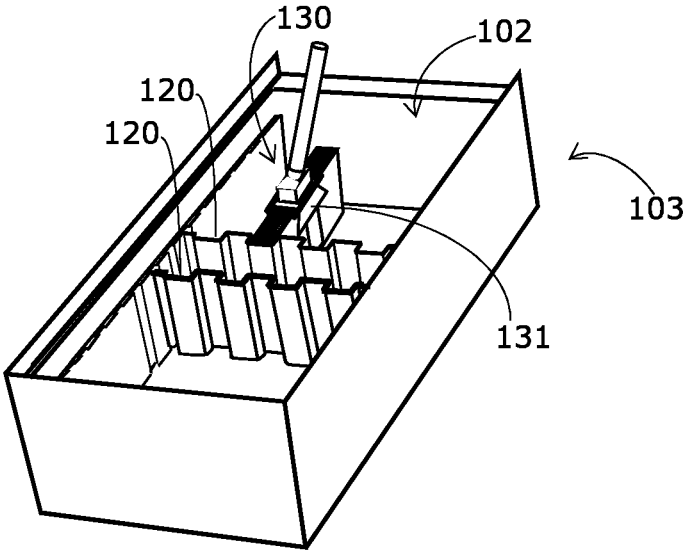
FIG. 6D shows the security cassette with the valuable paper bundle of FIG. 6C, wherein a gripper encloses the valuable paper bundle in order to be able to remove it.
Figure 6E:
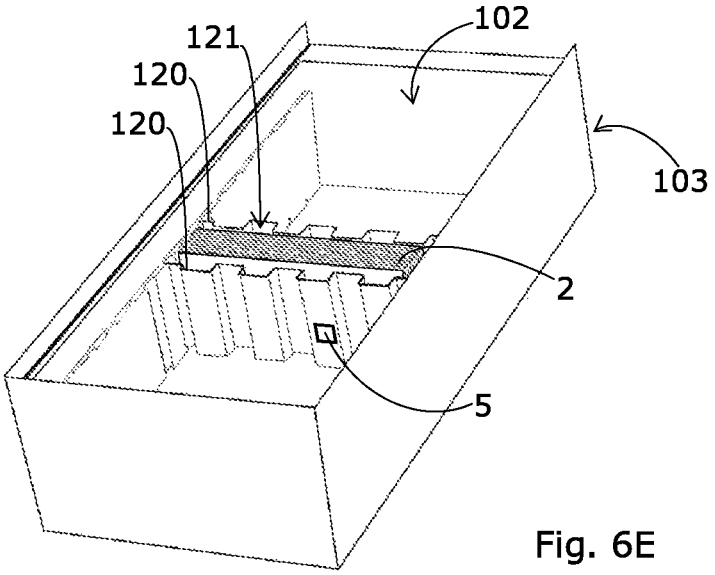
FIG. 6E shows the security cassette of FIG. 6A with the cover removed, wherein the security cassette has been equipped with two sub-dividers and contains a valuable paper bundle which is arranged in the transverse direction of the cassette.
Figure 6F:
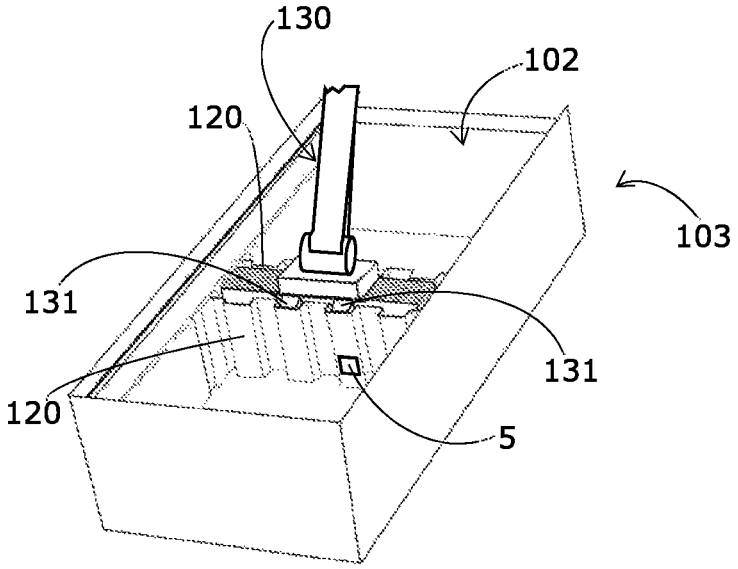
FIG. 6F shows the security cassette with the valuable paper bundle of FIG. 6E, wherein a gripper encloses the valuable paper bundle in order to be able to remove it.

If the first check did not reveal any abnormalities, the cover 102 can be separated from the lower part 103 as indicated in FIG. 6B (for simplicity's sake the security cassette 100 is shown empty).

FIG. 6C shows the security cassette 100 in the open, unarmed state. Here in this example, there is only one valuable paper bundle 2 inside the lower part 103 (also called receiving area 102). The security cassette 100 is equipped with two sub-dividers 120. The valuable paper bundle 2 is arranged parallel to the longitudinal direction of the security cassette 100.

FIG. 6D schematically shows a gripper 130, which has gripped the valuable paper bundle 2. After gripping, the gripper 130 can remove the bundle 2 and, for example, transfer it to an automatic counting machine 163 or place it on a base.

FIG. 6E shows the security cassette 100 in an open, unarmed state. Here in this example, there is only one valuable paper bundle 2 inside the lower part 103 (also called receiving area 102). The valuable paper bundle 2 is arranged parallel to the transverse direction of the security cassette 100. The security cassette 100 is equipped with two sub-dividers 120, between which the valuable paper bundle 2 is arranged. Due to the fact that the sub-dividers 120 have a ribbed structure 122, there are vertical intermediate spaces 121 between the sub-dividers 120 and the valuable paper bundles 2, which allow the penetration of or access by a gripper 130 or gripper element 131. Such an intermediate space 121 is shown in FIG. 6E.

FIG. 6F schematically shows a gripper 130, which has grabbed the valuable paper bundle 2. After gripping, the gripper 130 can remove the valuable paper bundle 2 and, for example, transfer it to an automatic counting machine 163 or place it on a base. In this embodiment, the gripper 130 has three finger-like gripper elements 131, of which two gripper elements engage in intermediate spaces 121, which result between the front sub-divider 120 and the valuable paper bundle 2. A third gripper element 131 (not shown here) engages in an intermediate space 121, which results between the rear sub-divider 120 and the valuable paper bundle 2.

The gripper 130 may be part of an automation system 200, which can be designed as a portal unit with linear guides, for example. The automation system 200 can also include a robot arm 201 with several joints, which carries and moves the gripper 130, as indicated in FIG. 7. The gripper may have any suitable configuration as should be appreciated by one of ordinary skill in the art.

Due to the fact that the information about the current configuration and loading of the security cassette 100 is available in the cash center CC, this security cassette 100 can be unloaded partially or fully automatically. A corresponding example is shown in FIG. 7.

This approach can be used to reduce the number of staff in the cash center CC, or to realize a cash center CC that requires no staff at all. This results in increased security against misuse and manipulation. In addition, such a cash center CC can be set up partly or completely different, since the needs of people do not have to be taken into account.

In such a cash center CC, precisely defined areas are specified in which, for example, an internal rack 162 with security cassettes 100 is stored. There may also be an area with an automatic counting machine 163 and an area for unloading one or more security cassettes 100.

If self-propelled robot vehicles 164 are used in the CC cash center, conveyor belts that were previously used can be omitted.

The internal rack 162 and/or the shelf 161 may be equipped with locks that allow the locks to be opened automatically. FIG. 8 shows one such lock 167. For this purpose, the internal rack 162 and/or shelf 162 may be equipped with a communication unit, e.g., to receive signals from a PDA 150 or a robot or robot arm 201.

This enables automated handling in which, for example, a robot or robot arm 201 specifically requests the internal rack 162 and/or shelf 161 to open one of the locks, so that the security cassette 100 can be automatically removed from the internal rack 162 or shelf 161.

In one embodiment, one electromagnetic or hydraulic device can be used per lock to open or release this lock.

In another embodiment, however, the internal rack 162 does not include its own intelligence and no communication unit. In this embodiment, the intelligence and communication unit are housed in shelf 161. If an internal rack 162 is to be removed from the shelf 161, the shelf 161 is first requested to release this internal rack 162. This is done by opening or releasing the corresponding lock.

While an internal rack 162 with several security cassettes 100 is removed from the shelf 161, these security cassettes 100 are in an armed state, wherein no travel time is predetermined as a time window.

In FIG. 7, a transport vehicle 160 is shown on the left, in the (armored) interior of which a shelf 161 with three internal racks 162 is arranged. In the example shown, which is schematic, there is a total of four security cassettes 100 in the right internal rack 162.

After removing this internal rack 162 from the transport vehicle 160, the aforementioned robot or robot arm 201, for example, can remove a security cassette 100 from the internal rack 162. In FIG. 7, a security cassette 100 in a horizontal position is shown below the gripper 130 of the robot or robot arm 201. Cover 102 has already been removed from the lower part 103. In the illustrated moment, the gripper 130 holds a valuable paper bundle 2. The block arrow, which in FIG. 7 points from the robot or robot arm 201 in the direction of the automatic counting machine 163, is to symbolize that the valuable paper bundle 2 is transferred to the automatic counting machine 163.

The internal rack 162 can be removed from the transport vehicle 160, for example, by means of a rail system 166, as schematically indicated in FIG. 7 in the area behind the vehicle 160. In FIG. 8, another exemplary vehicle 160 is shown from the rear in the open state. Two internal racks 162 are arranged on the right and left inside this vehicle 160. Each of the two 162 internal racks is equipped with six security cassettes 100 at the moment shown. On the left internal rack 162 the security cassettes 100 are indicated with dashed lines.

Vehicle 160 can be equipped with a rail system 166, which enables a partially or fully automated removal or discharge of the internal racks 162. The rails of the rail system 166 can be extended backwards out of the vehicle 160 as indicated in FIG. 7. The internal racks 162 can then be unloaded along the rails and transferred to a robot vehicle 164, for example.

The rectangular border, designated CC in FIG. 7, is intended to show that the cash center CC in this embodiment is fully automated and that no people need to be present inside the cash center CC.

While the above describes certain embodiments, those skilled in the art should understand that the foregoing description is not intended to limit the spirit or scope of the present disclosure. It should also be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. A method comprising:

transporting a security cassette, which contains at least one valuable paper bundle and which is closed with a cover, in a shelf or in an internal rack of a vehicle to a location configured to unload the at least one valuable paper bundle from the security cassette;

processing said security cassette, said processing including opening or removing the cover so as to allow access by a gripper of an automatically operating handling device to the at least one valuable paper bundle, wherein the gripper includes a gripping element, inserting the gripper into the security cassette, gripping the at least one valuable paper bundle with the gripper, and removing the at least one valuable paper bundle from the security cassette;

delivering, with the gripper, the at least one valuable paper bundle to a location outside of the security cassette; and processing the delivered at least one valuable paper bundle, wherein (1) the security cassette contains at least two adjacently arranged of the at least one valuable paper bundle oriented substantially parallel to one another and spaced apart by an intermediate space therebetween; or (2) the method includes mounting at least two sub-dividers in the security cassette parallel to one another so as to define between said at least two sub-dividers an area containing the at least one valuable paper bundle and an intermediate space between one of said at least two sub-dividers and the at least one valuable paper bundle; and the method further includes partially penetrating or entering the gripper element into the intermediate space before the gripping step.

2. The method as according to claim 1, wherein the method includes said mounting at least two sub-dividers, and the security cassette includes a receiving area configured to receive a plurality of valuable papers, wherein the at least one valuable paper bundle is located in the receiving area and the cover closes the receiving area, and a protective device configured to automatically trigger and devalue valuable papers in the receiving area, wherein the at least two sub-dividers are configured to divide the receiving area and to hold a plurality of valuable paper bundles that comprise a plurality of valuable papers that are bundled, in parallel and upright in the receiving area.

3. The method as according to claim 2, wherein each of the at least two sub-dividers defines a ribbed structure defined by one or more of a corrugation device, a vertical slit, or a succession of ribs and grooves.

4. The method as according to claim 2, wherein each of the at least two sub-dividers is configured to hold a plurality of valuable paper bundles perpendicularly to the sub-divider and adjacent valuable paper bundles separated from one another by a space therebetween.

5. The method as according to claim 2, wherein each of the at least two sub-dividers is configured to hold a plurality of valuable paper bundles substantially parallel to the sub-divider and adjacent valuable paper bundles separated from one another by the sub-divider.

6. The method as according to claim 5, wherein each of the at least two sub-dividers defines a ribbed structure on both sides thereof.

7. The method as according to claim 2, wherein the receiving area is defined by four side walls and a base, and at least two opposing of the side walls include at least one receiving structure configured to hold the at least two sub-dividers.

8. The method as according to claim 7, wherein the cover is configured to close a side of the receiving area, and the at least two sub-dividers and the at least one receiving structure are configured for insertion or introduction of the at least two sub-dividers into the at least one receiving structure from said side, and are further configured to orient the at least two sub-dividers perpendicularly to the at least two opposing side walls when inserted or introduced into the at least one receiving structure.

9. The method as according to claim 7, wherein the cover is configured to close a side of the receiving area, and the at least two sub-dividers are configured for insertion into the at least one receiving structure from said side such that the at least two sub-dividers are oriented perpendicularly to the two opposing side walls when inserted into the at least one receiving structure.

10. The method as according to claim 1, wherein the security cassette further comprises a memory configured to store one or more of security or transport data.

11. The method as according to claim 10, wherein said memory includes a non-changeable or non-erasable memory.

12. The method as according to claim 10, wherein the at least two sub-dividers each comprise a unique identification (UID) and the memory is configured to store said identification (UID).

13. The method as according to claim 12, wherein the unique identification comprises a unique machine-readable identification (UID).

14. The method as according to claim 10, wherein the memory is configured to store information about a current configuration of the security cassette.

15. The method as according to claim 1, wherein the gripper element is configured to grip a valuable paper bundle adjacent to said intermediate space.

16. The method according to claim 1, wherein the vehicle comprises a rail system configured to permit unloading the shelf or the internal rack from the vehicle.

17. The method according to claim 1, wherein the internal rack is configured to hold at least one additional security cassette and includes at least one lock configured to be opened automatically.

18. The method according to claim 1, wherein the transporting step includes transporting the security cassette in said internal rack, wherein said internal rack is located on said shelf, and further including removing the internal rack from the shelf and, upon removing the internal rack from the shelf, placing the security cassette into an armed state, wherein no travel time is predetermined as a time window.

* * * * *